US005679247A

United States Patent [19]

Burke

[11] Patent Number: 5,679,247

[45] Date of Patent: Oct. 21, 1997

[54] BOOM NETTING MATERIAL FOR CONTAMINATION CONTAINMENT

[75] Inventor: John F. Burke, Cortland, Ill.

[73] Assignee: Delaware Capital Formation, Inc., Wilmington, Del.

[21] Appl. No.: 539,731

[22] Filed: Oct. 5, 1995

[51] Int. Cl.[6] ..... E02B 15/10

[52] U.S. Cl. ..... 210/242.4; 210/924; 405/72

[58] Field of Search ..... 66/170; 210/691, 210/693, 242.4, 484, 924; 405/72

[56] References Cited

U.S. PATENT DOCUMENTS

| | | | |
|---|---|---|---|
| 3,565,257 | 2/1971 | Cavalieri | 210/242.4 |
| 3,679,058 | 7/1972 | Smith | 210/924 |
| 3,739,913 | 6/1973 | Bogosian | 210/924 |
| 4,038,699 | 8/1977 | Burn | 66/173 |
| 4,366,067 | 12/1982 | Golding et al. | 210/242.4 |
| 5,165,821 | 11/1992 | Fischer et al. | 210/242.4 |
| 5,227,072 | 7/1993 | Brinkley | 210/924 |

*Primary Examiner*—Ivars Cintins

*Attorney, Agent, or Firm*—Banner & Witcoff, Ltd.

[57] ABSTRACT

A spill retention boom is formed of a tubular mesh with an integral rib and filled with an absorbent material.

4 Claims, 2 Drawing Sheets

BOOM NETTING MATERIAL FOR CONTAMINATION CONTAINMENT

BACKGROUND OF THE INVENTION

This invention relates to an improved boom construction especially useful for controlling pollution spills on a body of fluid and a method for making such a boom as well as the material incorporated in such a boom.

Because of increased sensitivity to and awareness of the hazards of pollution in the environment, especially water pollution, various techniques have been developed to collect and control liquid spills. For example, oil spills may be subjected to chemical or biologic neutralization. Another important method to control spills, particularly floating, immiscible spills, is to absorb them from the surface of the body of water or fluid which has been contaminated. This is accomplished typically by means of absorbent materials in the form of sheets placed on the contaminant spill or by booms which enclose or retain and absorb the contaminate spill. This invention relates to the construction of booms useful for the containment and absorption of such spills.

Heretofore, absorbent booms were typically made of a woven fabric or mesh formed as a tube and filled with an absorbent material. The tube typically also included a rope extending longitudinally within the tube. Hooks or other gripping mechanisms were then used to control the position of the boom on the surface of a body of water. Inclusion of rope within the tube of mesh and absorbent material is considered necessary to provide a boom having sufficient length and strength to control a spill. The rope within the boom material is thus necessary to provide adequate tensile strength to the boom so that the boom may be held in position and moved without breaking.

Such booms are assembled by pulling a rope through the center of the closed mesh or netting as the netting is also filled with absorbent material. Hooks are then attached to the rope from outside once the ends of the boom are secured. Such a boom is popular in open water applications inasmuch as the boom can be picked up with heavy machinery once it absorbs petroleum or other pollutants. When the boom has absorbed pollutants, it becomes heavy and thus the strength of the center rope is needed in order to enable proper retrieval of such a boom.

The operation of threading the rope through such a boom is a rather cumbersome and difficult task. Thus, there has developed a need to provide an alternative boom construction and methodology which can replace the described construction.

SUMMARY OF THE INVENTION

Briefly, the present invention comprises a boom construction wherein a unitary, knitted fabric mesh defines a tube of netting material having a longitudinal axial dimension. The mesh further includes an integrally knitted longitudinal band or rib along the length of the tube of netting material. This integral knitted band or rib is comprised of the same material as the netting material and is integrally formed or woven with the netting. Absorbent fill material may be inserted into the tube of netting. The integral rib eliminates the need for a rope which previously would have been threaded or inserted into the tube of netting material with the absorbent fill.

Thus, it is an object of the invention to provide an improved netting material for manufacture of pollution retention or spill retention booms.

It is a further object of the invention to provide an improved boom construction which eliminates the need for a rope or similar tensile member within or attached to a tube of absorbent material yet which maintains a characteristic tensile strength to enable easy placement, retention and gathering of the boom.

Yet another object of the invention is to provide an improved boom construction which is less expensive and equally, if not more efficient, than prior art boom constructions.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
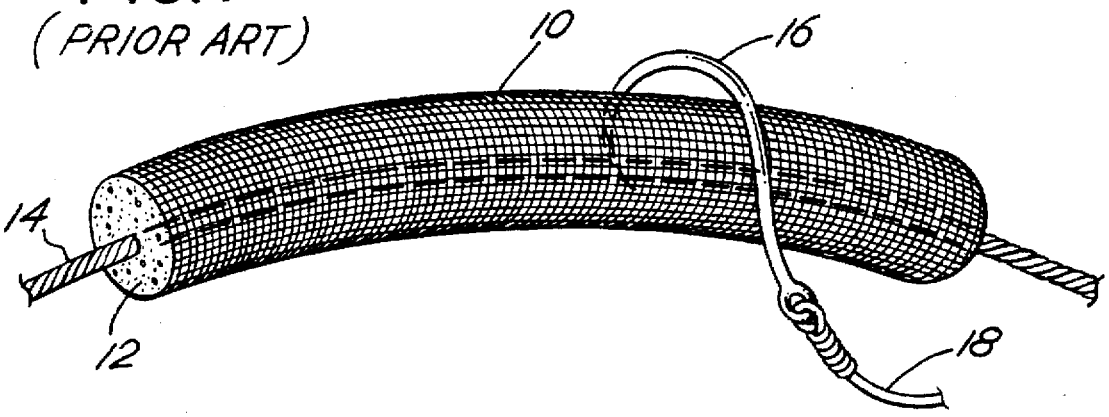
FIG. 1 (PRIOR ART)
FIG. 1 is an isometric view of a prior art boom construction including a rope and absorbent material retained within a knitted tube of mesh netting.

FIG. 1 depicts a typical prior art boom construction which is used for retention of spills and absorption of fluid such as oil spilled on water. The boom is comprised of a woven fabric mesh netting 10 which is woven so that it is formed as a continuous closed tube of netting material. Within the tube of netting 10 and retained by the netting is absorbent material which will absorb spilled fluid. For example, the absorbent material 12 may constitute a cotton absorbent. Also within the tubular mesh netting 10 is a longitudinal rope 14 which extends for the length of the tube of netting 10 and beyond. Rope 14 serves as a tensile member for the boom so that the boom may be easily lifted and positioned without tearing the netting 10. The ends of the rope 14 project beyond the tube of netting 10 and may be tied in a knot with the netting 10 to thereby close the end of the netting 10 and retain the absorbent material 12 within the tubular netting 10. The rope 14 may extend outwardly from the knot for attachment to a line or arm, for example. The rope 14 typically has greater tensile strength than the tensile strength of the netting 10. A hook 16 is typically utilized to help position, move and retrieve booms of the type shown in FIG. 1. The hook 16 may thus be attached to a rope or cable 18 and, in turn, pulled by an arm connected to a crane or derrick or some other support mechanism.

Figure 2:
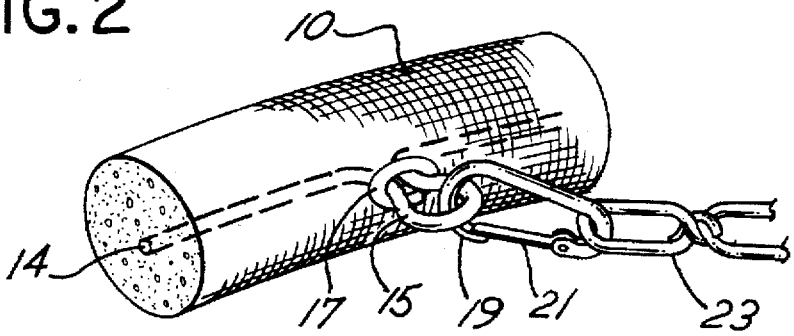
FIG. 2 is an enlarged isometric view of a section of the boom construction of FIG. 1 utilizing a unique method for attachment of a chain or rope to the boom.

FIG. 2 depicts a unique way that hooks or ropes or a chain may be fastened to a boom of the type shown in FIG. 1. Thus, the rope 14 as well as a section of the netting 10 may be formed as a loop 15 retained in position by a metal clip 17. A latching link 19 is fitted through the loop 15. Link 19 includes a biased closure arm 21 which will snap into position to retain a cable eye or chain link 23, for example.

When making a boom of the type shown in FIGS. 1 and 2, it is necessary to fill the mesh netting 10 with the absorbent material 12 and simultaneously or substantially simultaneously thread a rope 14 through the mesh netting 10. This is a time consuming and often difficult task. Also, the ends of the tube of netting 10 must be closed and the rope 14 typically must have a length extended beyond the ends of the netting 10 so that the rope 14 may be tied to hold the boom.

Figure 3:
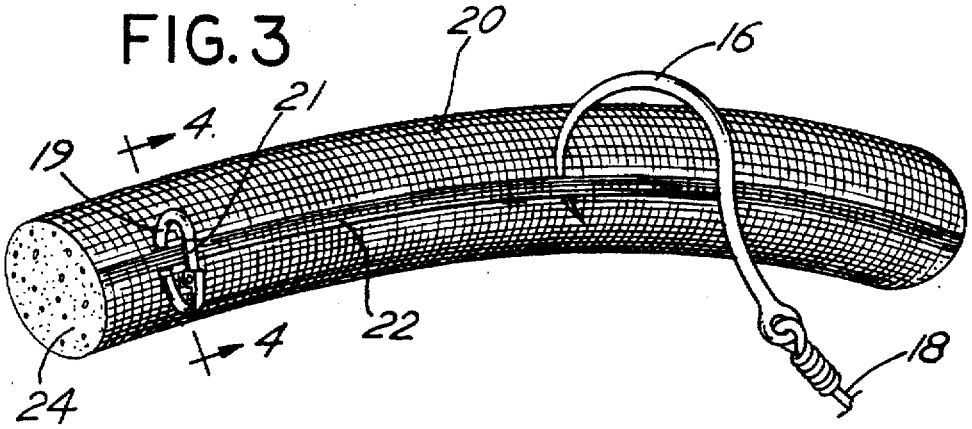
FIG. 3 is an isometric view of the improved netting material of the present invention incorporating absorbent material within the netting and wherein the netting includes integrally formed therewith a tensile band or rib.
Figure 5:
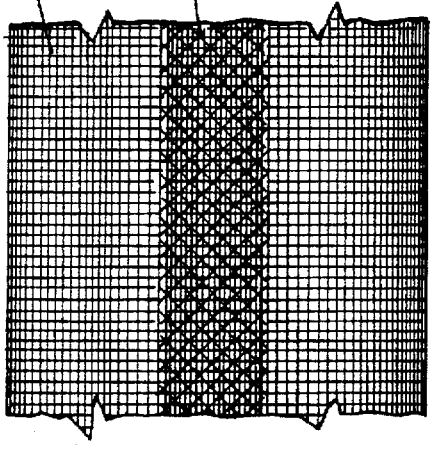
FIG. 5 is a side elevation of the boom construction of FIG. 4.
Figure 4:
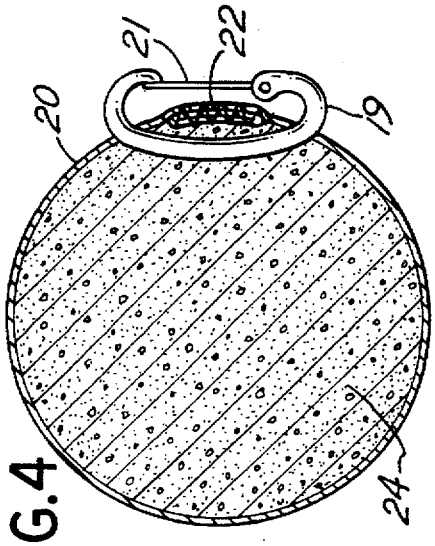
FIG. 4 is a section of the boom of FIG. 3 taken along the line 4—4.
Figure 6:
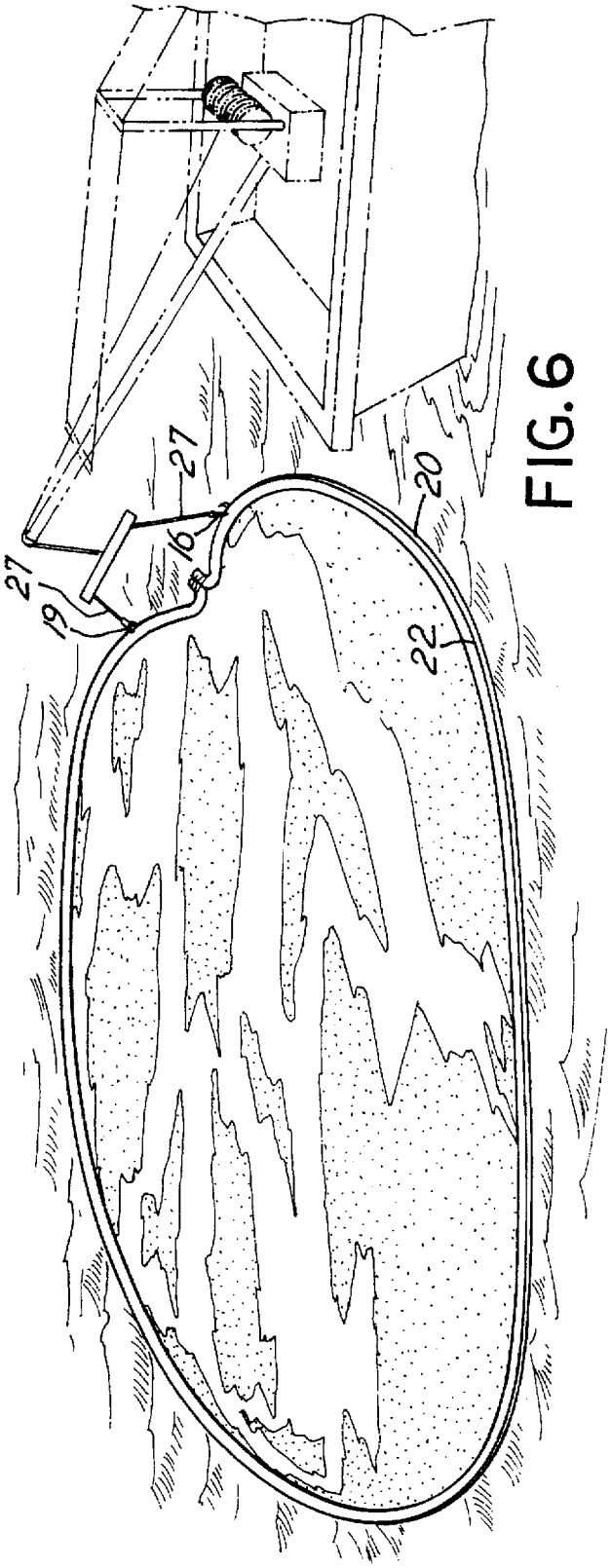
FIG. 6 is an isometric view of the boom construction of the invention as typically utilized to contain a spill.

FIGS. 3 through 5 illustrate the methodology and construction of the present invention. As shown in these figures, a tube of mesh netting 20 includes an integrally woven longitudinal band or rib 22. The band defines a reinforced rib 22 which acts as or defines a tensile member for the boom. Thus, it is unnecessary to thread a rope through the netting 20. Rather, absorbent material 24 may merely be placed within the tube netting 20 and the ends of the netting 20 tied in a knot or closed by a metal clip. Since, the integrally woven band 22 of fabric material serves as a tensile member, need for a rope is eliminated. In this manner, hook 16 supported by a rope 18 may be positioned to grapple the entire boom or may be fitted through the netting 20 over the rib or band 22 to hold and position the boom. Alteratively, a latching link 19 may be fitted around the rib 22 and thereby be made available to attach a cable eye or loop 27.

Following is an example of the method and construction of a typical boom utilizing the invention:

The material used is 500 denier polyester multifilament yarn. It is knit into netting form on a double-bar warp knitter. In this way the machine knits a front panel and a back panel, knits the panels together, and knits the rib 22 into the front panel all at once. The netting is comprised of 112 strings around the circumference of approximately 24 inches. An additional 16 strings are knit into the front panel to form the rib 22. Typically 300 foot rolls of netting are knit before doffing or changing them out. The rolls are then shipped to boom manufacturers each having their own method of boom construction which may be of a proprietary nature.

Alternative materials for manufacture of the netting include nylon, polypropylene or HDPE.

Alternative absorbent materials such as treated cellulose or polypropylene fluff may be used.

Also, the size of the rib or band 22 may be altered, for example, as follows: the number of strings may be increased thereby widening the rib and increasing the strength as stated below preferably in the range of ⅓ to 1/32 of the tube diameter. The diameter (d) of the tube may be altered. Diameters in the range of about 4 to 12 inches are typical. The band or rib 22 may be in the range of about ⅓ to 1/32 of the circumference (d). The denier of the knit yarn may be varied, for example, in the range of about 360 to 840 denier as may the number of strings per unit of circumference in the range of about 2 to 6 per inch of circumference with the rib 22 having 8 to 24 strings per inch of circumference. Also, the material in the netting 20 may be altered. For example, it may be encapsulated in a porus bag. Other variations are possible.

Additionally, multiple ribs 22 may be knitted about the circumference of the tube 20. Then separate attachment devices such as clips 19 may be attached to spaced ribs 22 so that multiple lines may be affixed to the tube. If the ribs 22 are on opposite sides of the tube 22, the tube 22 may be attached to lines extending in opposite direction which when pulled alternatively are useful to effect a sweeping action by the boom. The ribs 22 may be more closely spaced, however, so that they can be simultaneously attached and pulled. The rib 22 may also be knitted to define a spiral about the tube 20. The rib or ribs 22 may be knitted from a distinct color to effect identification of the size of the boom, or the absorbent material in the boom, or the strength of the boom material or other characteristics of the boom. The tube 20 may be knitted as a single unit with the higher density of strings about the entire circumference.

Thus, while there has been set forth a preferred embodiment of the invention, many alternatives are available and the invention is to be limited only by the following claims and equivalents thereof.

What is claimed is:

1. A boom construction for retaining spill matter on a body of fluid and absorbing spill matter, comprising, in combination:

a unitary, knitted fabric mesh of netting forming a closed tube having a longitudinal, axial dimension, said tube defining an enclosure for absorbent material;

said fabric mesh further including an integrally knitted longitudinal fabric band defining a longitudinal rib along one side of the netting, said rib formed of the same material as the mesh and integrally knitted with the mesh;

an absorbent fill material enclosed in the mesh netting and filling the closed tube for absorption of spill matter, said rib defining means for supporting the boom; and means attached to the rib for holding the boom in position relative to spill matter.

2. The boom of claim 1 wherein the netting has a diameter (d) in the range of about 4 to about 12 inches and the band has a circumferential dimension in the range of ⅓ $\pi d$ to about 1/32 $\pi d$.

3. The boom of claim 1 including a means to maintain the boom in position surrounding a spill on a body of fluid.

4. The boom construction of claim 1 including a clip extending about the rib for attachment to a support to hold the tube in position.

* * * * *